US005410323A

United States Patent [19]

Kuroda

[11] Patent Number: 5,410,323

[45] Date of Patent: Apr. 25, 1995

[54] PLANAR ANTENNA

[75] Inventor: Shinichi Kuroda, Tokyo, Japan

[73] Assignee: Sony Corporation, Tokyo, Japan

[21] Appl. No.: 949,539

[22] Filed: Apr. 19, 1993

[30] Foreign Application Priority Data

Apr. 24, 1992 [JP] Japan ..... 4-106928

[51] Int. Cl.[6] ..... H01Q 1/38

[52] U.S. Cl. ..... 343/700 MS; 343/830; 343/846

[58] Field of Search ..... 343/700 MS, 846, 829, 343/830, 848; H01Q 1/38, 21/06

[56] References Cited

U.S. PATENT DOCUMENTS

| | | | |
|---|---|---|---|
| 4,857,938 | 8/1989 | Tsukamoto et al. | 343/846 |
| 5,036,336 | 7/1991 | Bouko et al. | 343/776 |
| 5,216,430 | 6/1993 | Rahm et al. | 343/700 MS |
| 5,243,353 | 9/1993 | Nakahara et al. | 343/846 |
| 5,245,745 | 9/1993 | Jensen et al. | 343/700 MS |

OTHER PUBLICATIONS

Sharma et al., "Analysis and Optimized Design of Single Feed Circularly Polarized Microstrip Antennas", IEEE Transactions on Antennas and Propagation, vol. AP-31, No. 6, Nov. 1983.

*Primary Examiner*—Donald Hajec
*Assistant Examiner*—Hoanganh Le
*Attorney, Agent, or Firm*—Robert P. Biddle; Jerry A. Miller; Lise A. Rode

[57] ABSTRACT

A planar antennas has a square radiating conductor with a total of eight slits defined therein. Each of the slits extends from one side of the radiating conductor parallel to opposing sides flanking the one side. The slits are positioned such that they slits remain in the same pattern when the radiating conductor is turned 90°. Any changes in the impedance as the offset length of a feeding point from the center of the planar antenna are relatively small, specifically range from 0 ohm to 400 ohm. The planar antenna is small in size, is easy to achieve impedance matching with a general feeding system having an impedance of 50 ohms, for example, and has wider frequency band. The planar antenna is also capable of generating circularly polarized electromagnetic waves.

6 Claims, 8 Drawing Sheets

PLANAR ANTENNA

BACKGROUND OF THE INVENTION

1. Field of the Invention

The present invention relates to a planar antenna of a relatively small size and a low input impedance, which is preferable for use as an antenna in a GPS (global positioning system), for example.

2. Description of the Prior Art

Generally, planar antennas that are of a simple and rugged structure, small in size, and of a low profile are widely known as antennas suitable for use in satellite communications and mobile communications.

Mostly, circularly polarized electromagnetic waves are used in satellite communications and mobile communications.

FIG. 1 of the accompanying drawings shows a conventional planar antenna according to the invention entitled "small-size microstrip antenna" that is disclosed in Japanese laid-open patent publication No. 2-48803. The disclosed planar antenna comprises a circular radiating conductor 1 having four deep notches 3~6 defined therein at 90°-spaced angular positions and extending radially inwardly from the outer circular edge of the circular radiating conductor 1 toward the center thereof, the notches 3~6 being symmetrically arranged with respect to a feeding point 2. It is also described that the planar antenna of this structure has a low resonant frequency and is small in size, and that the radiating conductor 1 may be of a square shape rather than the circular shape.

It is desirable that planar antennas allow easy impedance matching with associated feeding systems and have a wide frequency band in certain fields of communications.

With the conventional planar antenna shown in FIG. 1, however, as the length of an offset of the feeding point 2 from the center of the circular radiating conductor 1 varies, the impedance varies to a relatively large extent, making it difficult to achieve impedance matching with a feeding system having an impedance of 50 ohms.

OBJECTS AND SUMMARY OF THE INVENTION

It is therefore an object of the present invention to provide a planar antenna which allows relatively easy impedance matching with an associated feeding system, has a relatively wide frequency band, and is small in size.

According to the present invention, there is provided a planar antenna comprising a dielectric substrate, a ground conductor mounted on one surface of the dielectric substrate, and a rectangular radiating conductor mounted on an opposite surface of the dielectric substrate, the radiating conductor having at least four slits defined therein, each of the slits extending from one side of the radiating conductor parallel to opposing sides flanking the one side, the slits being positioned such that the slits remain in the same pattern when the radiating conductor is turned 90°.

The radiating conductor may have a pair of recesses defined in respective diagonally opposite corners thereof.

The radiating conductor may have a pair of perturbation segments on respective opposite ends thereof.

The radiating conductor preferably has a total of eight slits defined therein, and two of the slits extend parallel to each other, from each side of the radiating conductor toward the center thereof, and lie parallel to opposing sides of the radiating conductor that flank the two of the slits.

The radiating conductor may have a pair of stubs on respective diagonally opposite corners thereof.

With the above arrangement, the resonant frequency of the planar antenna is lowered to allow the planar antenna to be relatively small in size. Any changes in the impedance as the offset length of a feeding point from the center of the planar antenna are relatively small. Therefore, the planar antenna is easy to achieve impedance matching with a general feeding system having an impedance of 50 ohms, for example, and has wider frequency band. The planar antenna is also capable of generating circularly polarized electromagnetic waves.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 1:
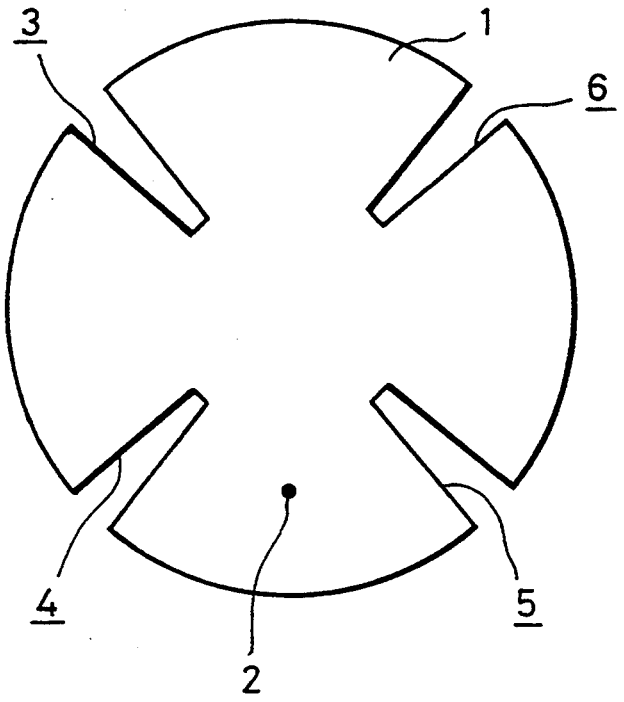
FIG. 1 (PRIOR ART)
FIG. 1 is a plan view of a conventional planar antenna.

Identical parts are denoted by identical reference numerals throughout views.

Figure 2A:
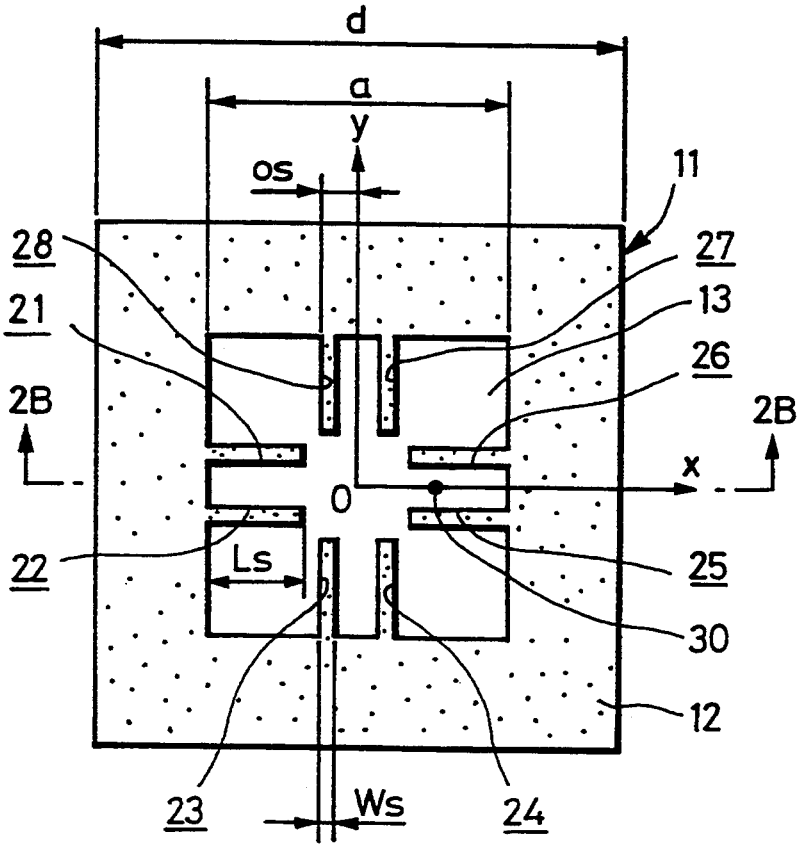
FIG. 2A is a plan view of a planar antenna according to an embodiment of the present invention.
Figure 2B:
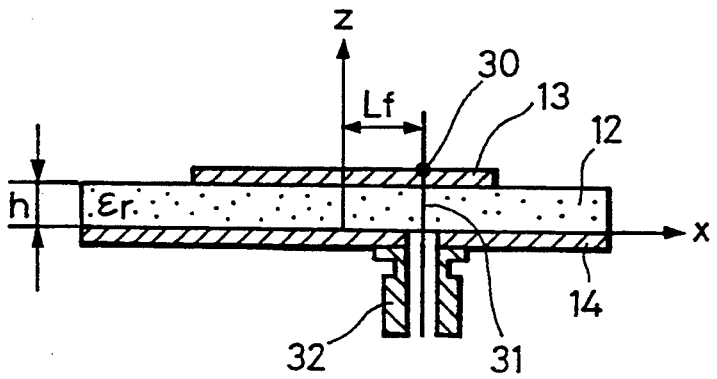
FIG. 2B is cross-sectional view taken along line 2B—2B of FIG. 2A.

FIGS. 2A and 2B show a planar antenna 11 according to an embodiment of the present invention. The planar antenna 11 is in the form of a microstrip antenna (MSA). The planar antenna 11 comprises a dielectric substrate 12, a square radiating conductor 13 mounted on one surface of the dielectric substrate 12, a ground conductor 14 mounted on an opposite surface of the dielectric substrate 12. Therefore, the radiating conductor 13 and the ground conductor 14 are disposed in confronting relationship to each other across the dielectric substrate 12.

The radiating conductor 13 has a total of eight slits 21~28 defined therein. Specifically, two of the slits 21~28 extend parallel to each other, from each side of the radiating conductor 13 toward the center thereof, and lie parallel to opposing sides of the radiating conductor 13 that flank the two slits. The radiating conductor 13 with the slits 21~28 has its inherent values lowered, and hence may be reduced in size.

The slits 21~28 are positioned in the radiating conductor 13 such that the slits remain in the same pattern when the radiating conductor 13 is angularly moved 90° about the center of the radiating conductor 13, i.e., the origin O of X- and Y-axes on the radiating conductor 13. Thus, the planar antenna 11 maintain two orthogonal modes for generating circularly polarized electromagnetic waves. An actual arrangement for generating circularly polarized electromagnetic waves will be described below.

The radiating conductor 13 may have four slits each extending one of the sides thereof toward the center, or may generally have a plurality of slits (4, 8, 12, . . . ) whose number is a multiple of four.

To achieve impedance matching between the planar antenna 11 and an associated feeding system, the planar antenna 11 has a feeding point 30 that is spaced or offset from the origin O by a distance or offset length Lf (see FIG. 2B). It is known that the input impedance of the planar antenna 11 is basically zero at the origin O, and gradually increases toward the sides of the planar antenna 11.

Therefore, it is possible to achieve impedance matching with a feeding system having an impedance of 50 ohms by selecting a suitable offset position for the location of the feeding point 30, without using any impedance matching circuit.

The feeding point 30 is connected to the core of a feeding connector 32 as a feeding port through a conductor pin 31 which extends across and through the dielectric substrate 12. The feeding connector 32 has a ground sheath connected to the ground conductor 14. The feeding point 30 may be connected to the core of the feeding connector 32 through a through hole. The planar antenna 11 is fed with signal power from the feeding system through the feeding connector 32.

Figure 3A:
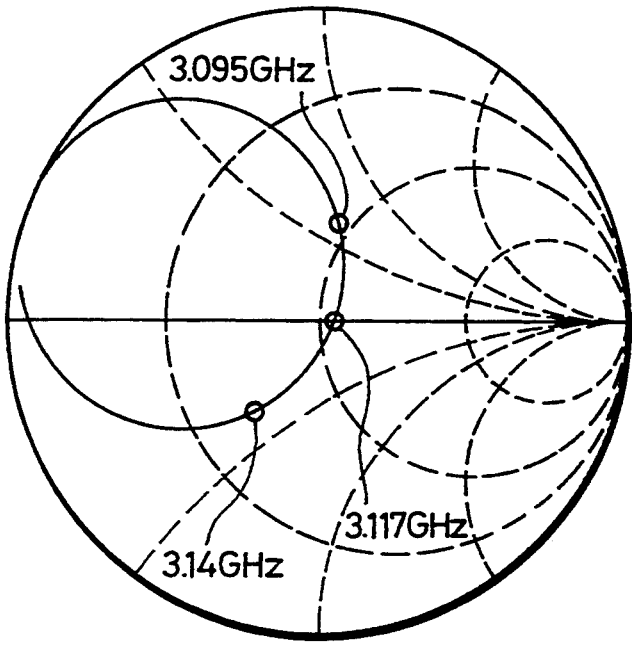
FIGS. 3A and 3B are diagrams showing input impedance characteristics of the planar antenna shown in FIGS. 2A and 2B.
Figure 3B:
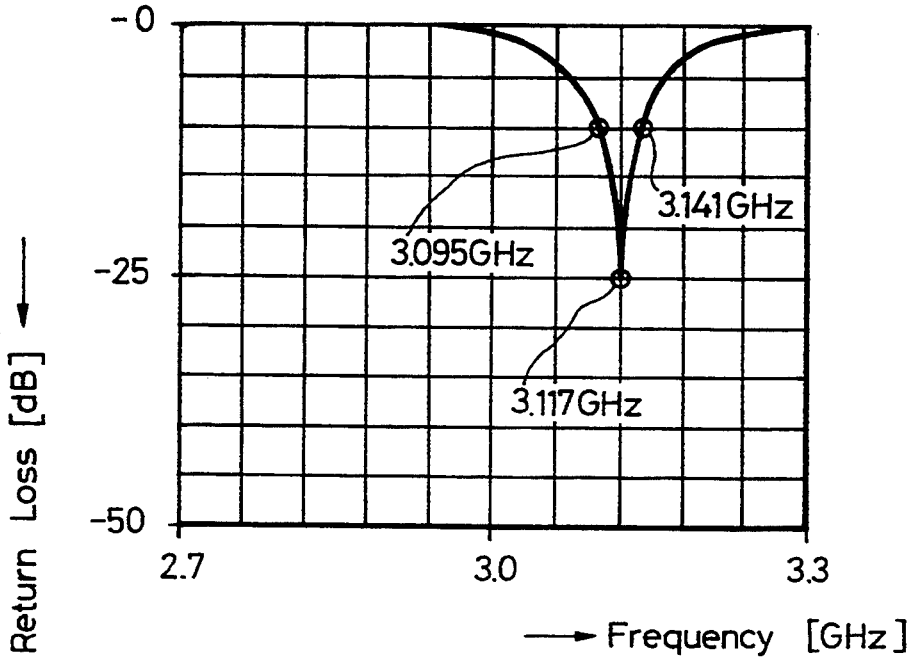

FIGS. 3A and 3B illustrate input impedance characteristics of the planar antenna 11. The data shown in FIGS. 3A and 3B were plotted when the frequency used was $f \approx 3$ GHz, and as shown in FIG. 2A, the radiating conductor 13 had a side length a, each of the slits 21~28 had a width ws and a length Ls, was spaced from the X- or Y-axis by a distance os, the dielectric substrate 12 had a thickness h, the ground conductor 14 (dielectric substrate 12) had a side length d, and the dielectric substrate had a dielectric constant $\epsilon r$ as follows:

a=25.7 mm; Ws=1.2 mm; Ls=5 mm
os=5.8 mm; h=1.6 mm; d=75 mm
$\epsilon r$=2.6

As can be seen from FIGS. 3A and 3B, the planar antenna 11 has a good impedance match at a central frequency of 3.117 GHz. A bandwidth BW at a return loss of −9.54 dB is BW=3.141−3.095=46 MHz or less (VSWR≦2).

A square patch antenna with no slits which operates at the same frequency as the planar antenna 11 included a radiating conductor having a side length a of 29.6 mm and a ground conductor (dielectric substrate) having a side length d of 80 mm. Therefore, the planar antenna 11 may have a size smaller than such a square patch antenna with no slits. It has been confirmed that the planar antenna 11 has a radiation pattern substantially equivalent to that of the square patch antenna.

Figure 4:
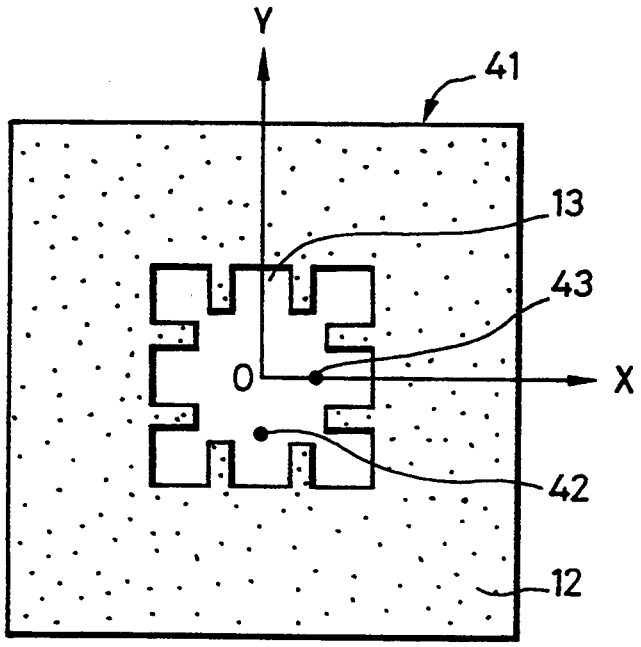
FIG. 4 is a plan view of a planar antenna according to another embodiment of the present invention.

FIG. 4 shows a planar antenna according to another embodiment of the present invention.

The planar antenna, generally denoted at 41, has two feeding points 42, 43 on a radiating conductor 13. The feeding point 42 is positioned on the X-axis and offset from the origin O and the feeding point 43 is positioned on the Y-axis and offset from the origin O. Two feeding ports (not shown) are disposed on a ground conductor that confronts the radiating conductor 13 across a dielecric substrate 12. The feeding ports are connected to the feeding points 42, 43, respectively, through respective conductor pins through the dielectric substrate 12.

The planar antenna 41 can generate a circularly polarized electromagnetic wave when the feeding points 42, 43 are supplied with respective signal powers that are 90° out of phase with each other.

Figure 5:
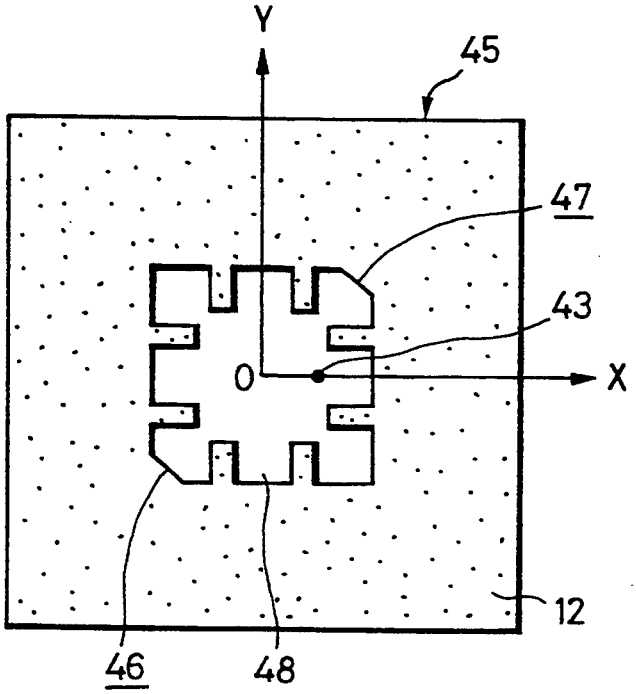
FIG. 5 is a plan view of a planar antenna according to still another embodiment of the present invention.

FIG. 5 shows a planar antenna according to still another embodiment of the present invention.

The planar antenna, generally denoted at 45, has a single feeding point 43 on a radiating conductor 48, the feeding point 43 being positioned on the X-axis and offset from the origin O. The radiating conductor 48 is different in configuration from the radiating conductor 13 in that the radiating conductor 48 has a pair of recesses or beveled edges 46, 47 on respective diagonally opposite corners thereof. The planar antenna 45 can generate a circularly polarized electromagnetic wave due to perturbation when the feeding point 43 is supplied with a signal power.

Figure 6:
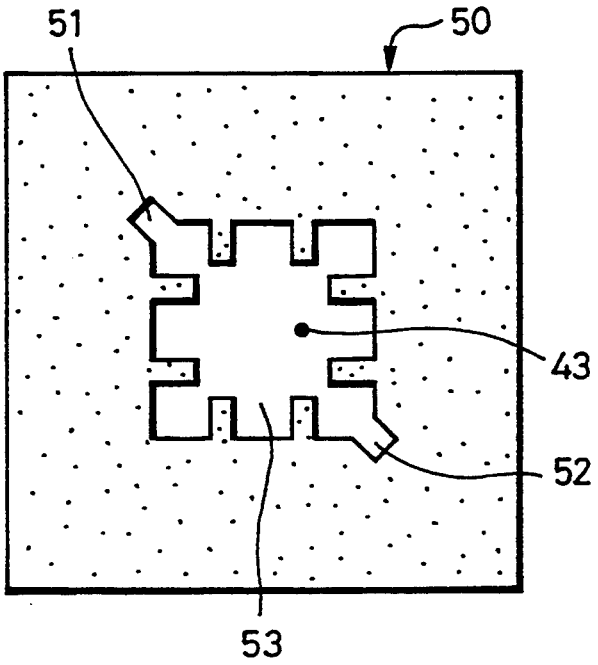
FIG. 6 is a plan view of a planar antenna according to a further embodiment of the present invention.

FIG. 6 shows a planar antenna according to a further embodiment of the present invention.

The planar antenna, generally denoted at 50, has a single feeding point 43 on a radiating conductor 53. The radiating conductor 53 is different in configuration from the radiating conductor 13 in that the radiating conductor 53 has a pair of stubs 51, 52 on respective diagonally opposite corners thereof. The planar antenna 50 can generate a circularly polarized electromagnetic wave as the stubs 51, 52 function as perturbation segments.

Figure 7:
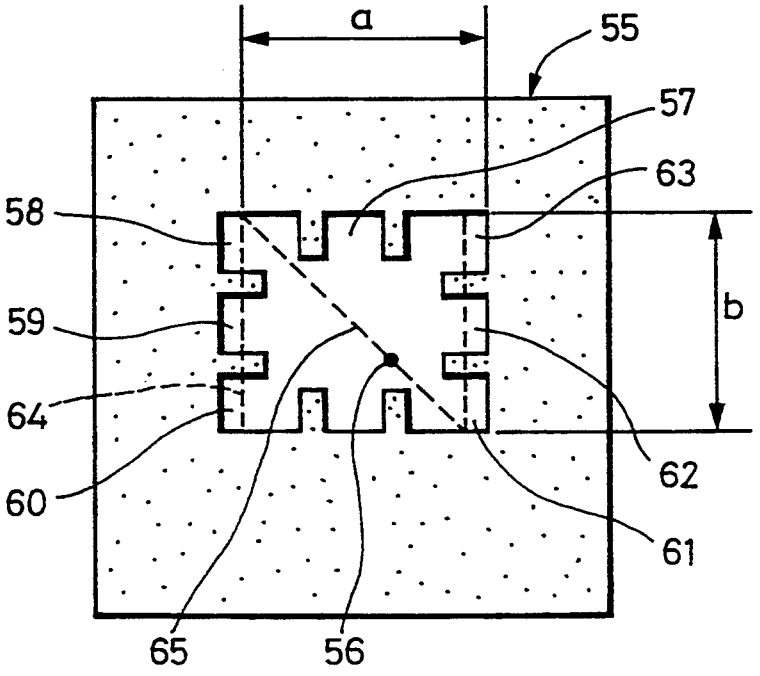
FIG. 7 is a plan view of a planar antenna according to a still further embodiment of the present invention.

FIG. 7 illustrates a planar antenna according to a still further embodiment of the present invention.

The planar antenna, generally denoted at 55, has a single feeding point 56 on a radiating conductor 57. The radiating conductor 55 is different in configuration from the radiating conductor 13 in that the radiating conductor 55 is in the form of an elongate rectangle having a side length a along the X-axis which is larger than a side length b along the Y-axis, providing perturbation segments 58, 59, 60 on one longitudinal end of the radiating conductor 57 and perturbation segments 61, 62, 63 on the other longitudinal end of the radiating conductor 57. The feeding point 56 is positioned on a diagonal line 65 of a square 64 on the radiating conductor 57, the square 64 having sides each of the length b and being coextensive with the area of the radiating conductor 57 except for the perturbation segments 58~63. The planar antenna 55 is also capable of generating a circularly polarized electromagnetic wave due to the perturbation segments 58~63. The slits in the radiating conductor 57 are positioned such that the slits remain in the same pattern when the radiating conductor 57 is angularly moved 90° about the center of the radiating conductor 57.

Comparison of the characteristics of the planar antenna 11 (inventive planar antenna) shown in FIGS. 2A and 2B and a conventional planar antenna (comparative planar antenna) will be described below.

Figure 8A:
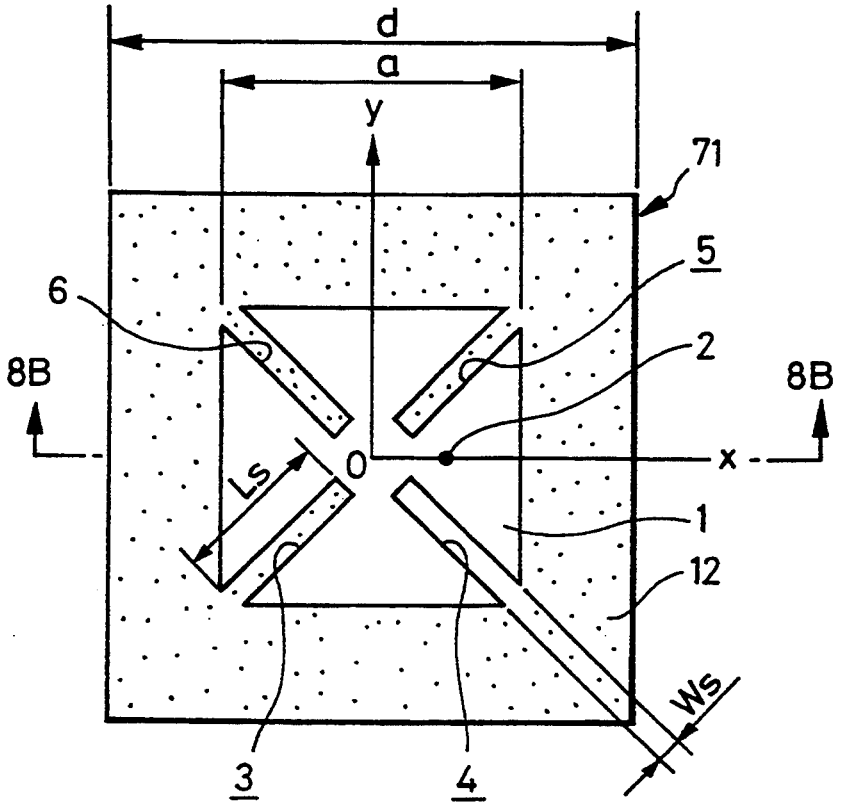
FIG. 8A is a plan view of a planar antenna according to a comparative example.
Figure 8B:
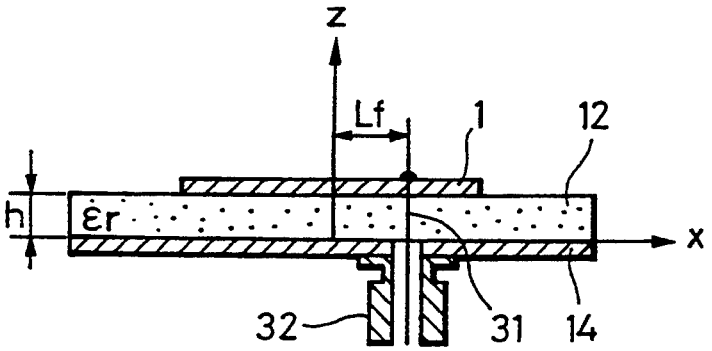
FIG. 8B is cross-sectional view taken along line 8B—8B of FIG. 8A.

FIGS. 8A and 8B show a conventional planar antenna 71. The planar antenna 71 has a square radiating conductor 1 on a dielectric substrate 12, the radiating conductor 1 having four notches 3~6 defined therein which extend from the respective four corners of the radiating conductor 1 toward its center. The planar antenna 71 has a feeding point 2 positioned on the X-axis and offset from the origin O by a distance Lf.

Figure 9:
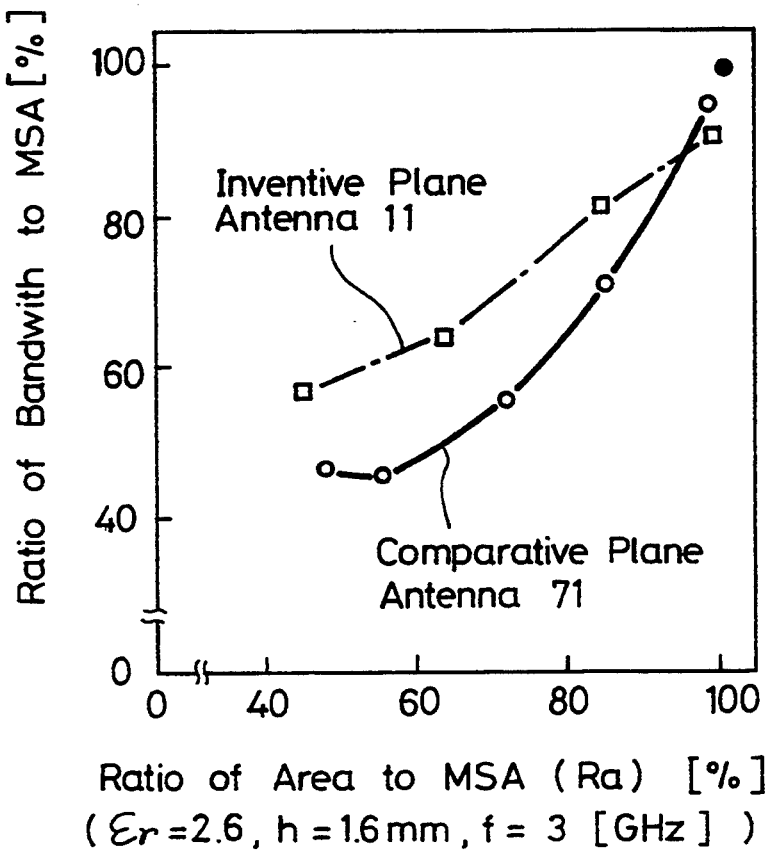
FIG. 9 is a diagram showing the relationship between an area ratio and a band width ratio of the planar antennas shown in FIGS. 1A and 8A.
Figure 10:
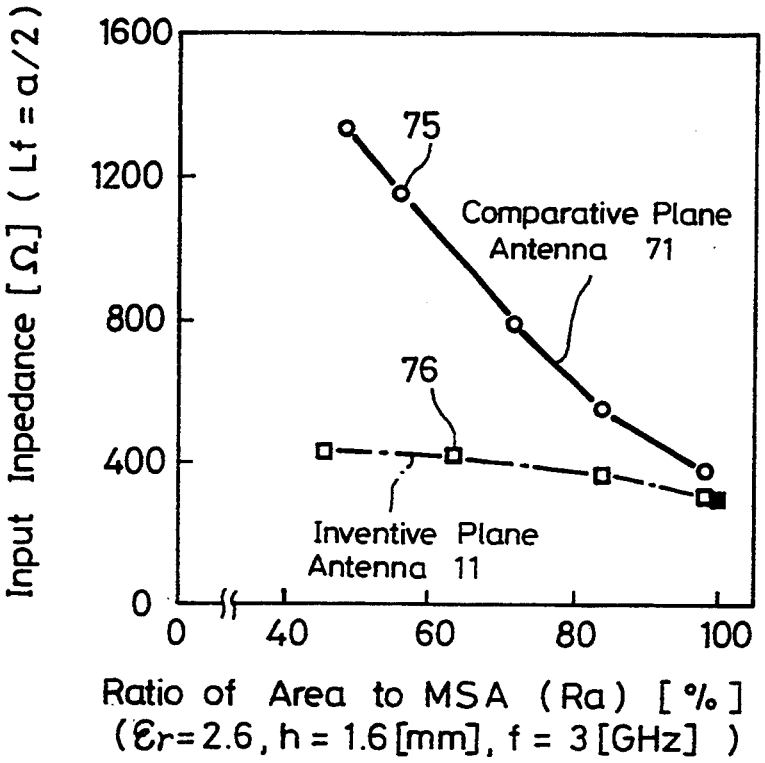
FIG. 10 is a diagram showing the relationship between an area ratio and an input impedance of the planar antennas shown in FIGS. 1A and 8A.

FIGS. 9 and 10 show various characteristics of the inventive planar antenna 11 and the comparative planar antenna 71. In FIGS. 9 and 10, a mark • indicates characteristics of a conventional square patch antenna with no slits 21~28, a curve plotted along marks □ indicates characteristics of the inventive planar antenna 11, and a curve plotted along marks indicates characteristics of the comparative planar antenna 71.

The graph of FIG. 9 has a horizontal axis representing an area ratio and a vertical axis representing a frequency bandwidth ratio. The area ratio is the ratio of the area (vertical dimension×horizontal dimension) of the radiating conductors 13, 1 to the area of the radiating conductor of the square patch antenna with no slits 21~28. The radiating conductor 13, the radiating conductor 1, and the radiating conductor of the square patch antenna are shaped such that the frequency f used by the antennas is 3 GHz. The frequency bandwidth ratio is the ratio of the bandwidth of the inventive and comparative planar antennas to the bandwidth of the square patch antenna.

Study of FIG. 9 shows that the bandwidth of the inventive planar antenna 11 is wider than the bandwidth of the comparative planar antenna 71.

The graph of FIG. 10 has a horizontal axis representing the area ratio and a vertical axis representing the input impedance at the sides of the radiating conductors 13, 1 (feeding point offset length Lf=a/2). It can be understood from FIG. 10 that the input impedance of the inventive planar antenna 11 remains to be of substantially 400 ohms even when the area ratio varies, and that the input impedance of the comparative planar antenna 71 varies to a larger extent as the area ratio varies and has a relatively large value. For impedance matching with a feeding system having an impedance of 50 ohms, it is preferable for a planar antenna to have smaller input impedance changes and a relatively small input impedance when the area ratio varies. The inventive planar antenna 11 is thus easier to obtain impedance matching than the comparative planar antenna 71.

Figure 11:
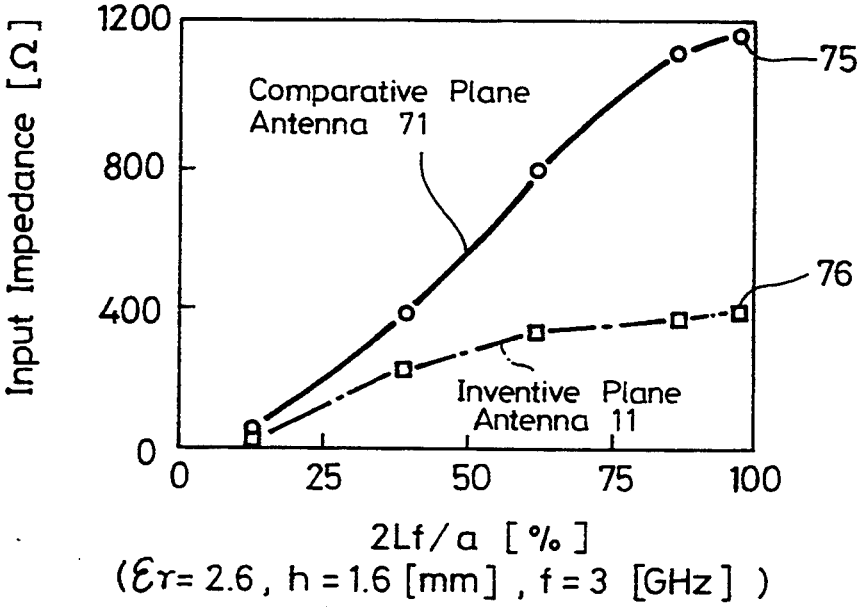
FIG. 11 is a diagram showing the relationship between a feeding point offset length ratio and an input impedance of the planar antennas shown in FIGS. 1A and 8A.

FIG. 11 shows changes in the input impedance with respect to the percentage feeding point offset length ranging from the origin 0 (feeding point offset length Lf=zero, and hence percentage feeding point offset length: 2Lf/a×100%=zero %) to a side (percentage feeding point offset length: 2Lf/a×100%={2(a/2-)/a×100%=100%) for the inventive planar antenna 11 whose characteristics are indicated by the mark 76 in FIG. 10 and the comparative planar antenna 71 whose characteristics are indicated by the mark 75 in FIG. 10.

FIG. 11 indicates that the inventive planar antenna 11 can easily achieve impedance matching with a general feeding system having an impedance of 50 ohms, for example, because the input impedance of the inventive planar antenna 11 has a smaller absolute input impedance value and varies to a smaller degree than the comparative planar antenna 71.

The planar antenna according to the present invention has at least four slits defined in a rectangular radiating conductor and each extending from one side of the radiating conductor parallel to opposing sides flanking the one side, the slits being positioned such that the slits remain in the same pattern when the radiating conductor is turned 90°. Consequently, the planar antenna 11, for example, of the structure shown in FIGS. 2A and 2B is capable of generating circularly polarized electromagnetic waves and is smaller in size than the square patch planar antenna. Any changes in the impedance as the offset length of the feeding point from the center are relatively small. Therefore, the planar antenna 11 is also easier to achieve impedance matching with a general feeding system having an impedance of 50 ohms, for example, and has wider frequency band than the comparative planar antenna 71.

The planar antennas 41, 45, 50, 55 shown in FIGS. 4, 5, 6, 7, respectively, also offer the same advantages.

Having described preferred embodiments of the invention with reference to the accompanying drawings, it is to be understood that the invention is not limited to that precise embodiments and that various changes and modifications could be effected by one skilled in the art without departing from the spirit or scope of the invention as defined in the appended claims.

What is claimed is:

1. A planar antenna comprising:

a dielectric substrate;

a ground conductor mounted on one surface of said dielectric substrate;

a radiating conductor having a geometric center and a perimeter, said radiating conductor being mounted on an opposite surface of said dielectric substrate and defining eight slits, wherein said slits are positioned to remain in the same pattern when said radiating conductor is turned 90 degrees, wherein two of said slits are positioned on each side of said radiating conductor, and wherein each of said slits extends from one side of said radiating conductor parallel to opposing sides flanking said one side; and, a single feed point located on said radiating conductor at a position intermediate said center and said perimeter.

2. The planar antenna of claim 1, further comprising:

a feeding connector connected to said ground conductor, and;

a conductor pin disposed within said feeding connector, wherein said conductor pin extends through said dielectric substrate and is connected to said feed point.

3. A planar antenna comprising:

a dielectric substrate;

a ground conductor mounted on one surface of said dielectric substrate;

a radiating conductor having a geometric center, a perimeter, and two axes, said radiating conductor being mounted on an opposite surface of said dielectric substrate and defining eight slits, said radiating conductor further having a pair of stubs on respective diagonally opposite corners thereof, wherein said slits are positioned to remain in the same pattern when said radiating conductor is turned 90 degrees, wherein two of said slits are positioned on each side of said radiating conductor, and wherein each of said slits extends from one side of said radiating conductor parallel to opposing sides flanking said one side; and, a single feed point located on one of said two axes between said center and said perimeter.

4. The planar antenna of claim 3, further comprising:

a feeding connector connected to said ground conductor, and;

a conductor pin disposed within said feeding connector, wherein said conductor pin extends through said dielectric substrate and is connected to said feed point.

5. A planar antenna comprising:

a dielectric substrate;

a ground conductor mounted on one surface of said dielectric substrate;

a radiating conductor having a geometric center, a perimeter, and an X- and Y-axis, said radiating conductor being mounted on an opposite surface of said dielectric substrate and defining eight slits, wherein said slits are positioned to remain in the same pattern when said radiating conductor is turned 90 degrees, two of said slits being positioned on each side of said radiating conductor, and each of said slits extending from one side of said radiating conductor parallel to opposing sides flanking said one side; and, two feed points located on said radiating conductor, wherein one feed point is located on said X-axis between said center and said perimeter, and the other feed point is located on said Y-axis between said center and said perimeter.

6. The planar invention of claim 5, further comprising:

a feeding connector connected to said ground conductor, and;

a conductor pin disposed within said feeding connector, wherein said conductor pin extends through said dielectric substrate and is connected to said feed point.

* * * * *